United States Patent [19]

Ikenoue et al.

[11] 4,349,623

[45] Sep. 14, 1982

[54] SILVER HALIDE PHOTOGRAPHIC MATERIALS

[75] Inventors: Shinpei Ikenoue; Hiroyuki Mifune; Yoshiharu Fuseya, all of Minami-ashigara, Japan

[73] Assignee: Fuji Photo Film Co., Ltd., Kanagawa, Japan

[21] Appl. No.: 159,569

[22] Filed: Jun. 16, 1980

[30] Foreign Application Priority Data

Jun. 15, 1979 [JP] Japan ..... 54/76160

[51] Int. Cl.[3] ..... G03C 1/28

[52] U.S. Cl. ..... 430/600; 430/569; 430/603; 430/605

[58] Field of Search ..... 430/600, 603, 614, 569, 430/605

[56] References Cited

U.S. PATENT DOCUMENTS

| | | | |
|---|---|---|---|
| 1,574,944 | 3/1926 | Sheppard | 430/603 |
| 1,763,989 | 6/1930 | Sheppard et al. | 430/614 |
| 2,870,015 | 1/1959 | Allen et al. | 430/614 |
| 3,080,254 | 3/1963 | Grant | 430/616 |
| 4,224,403 | 9/1980 | Toda et al. | 430/614 |

*Primary Examiner*—J. Travis Brown

*Attorney, Agent, or Firm*—Sughrue, Mion, Zinn, Macpeak & Seas

[57] ABSTRACT

A silver halide photographic material is described, comprising an emulsion which is chemical-ripened in the presence of a compound having the formula (I) or (II),

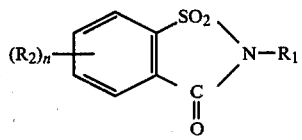

(I)

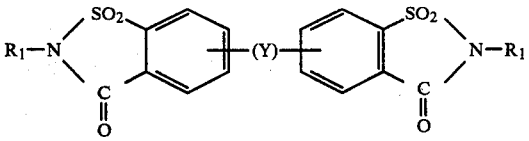

(II)

wherein $R_1$ is hydrogen, an alkali metal ion, or an ammonium ion; $R_2$ is an alkyl group, an alkoxy group, an aryloxy group, an acyl group, an amino group, a substituted amino group, a halogen atom, an acyloxy group, an acylamino group, a carbamoyl group, a nitro group, an aryl group, an allyl group, a sulfo group or a carboxy group; Y represents a divalent linking group; and n is 0, 1, or 2; such emulsions show high sensitivity without fog and have good stability.

25 Claims, No Drawings

SILVER HALIDE PHOTOGRAPHIC MATERIALS

BACKGROUND OF THE INVENTION

1. Field of the Invention

This invention relates to silver halide photographic materials and, particularly, to silver halide photographic materials using chemically sensitized high-speed silver halide emulsions.

2. Description of the Prior Art

The production step of silver halide photographic emulsions generally includes "ripening", which is typically divided into a "pre-ripening" (i.e., a formation step of silver halide and a physical ripening step thereof) and a "post-ripening" (i.e., a chemical ripening step).

As a sensitizing process in the pre-ripening process, a process is known using a solvent for silver halides. Silver halide solvents generally used can include ammonia, potassium thiocyanate, and thioether compounds, but these compounds do not always have sufficiently satisfactory properties.

For example, the use of ammonia causes the defects that "fog" is liable to form and the material may give off an offensive smell. Thioether compounds are also liable to cause fog. Potassium thiocyanate causes problems from a toxicity point of view.

On the other hand, in sensitizing processes involving the post-ripening step, many chemical sensitization processes are known.

For instance, a sulfur sensitization process is known wherein a compound containing sulfur capable of reacting with silver ions or active gelatin is used, a reduction sensitization process is known wherein a reducing substance is used, and a noble metal sensitization process is known wherein a gold compound or other noble metal compounds are used. These processes can be used individually or in combination with each other.

Sulfur sensitizers that can be used include thiosulfates, thioureas, thiazoles, rhodanines, and other various compounds. Practical examples of such sensitizers are described in U.S. Pat. Nos. 1,574,944, 2,410,689, 2,278,947, 2,728,668, 3,656,955, 4,030,928, and 4,067,740.

As reduction sensitizers, stannous salts, amines, hydrazine derivatives, formamizinesulfinic acids, silane compounds, etc., can be used, and practical examples thereof are described in U.S. Pat. Nos. 2,487,850, 2,419,974, 2,518,698, 2,983,609, 2,983,610, 2,694,637, 3,930,867, and 4,054,458.

For noble metal sensitization, gold complex salts, as well as other complex salts of metals belonging to group VIII of the Periodic Table, such as platinum, iridium, and palladium, can be used, and practical examples thereof are described in U.S. Pat. Nos. 2,399,083 and 2,448,060, and British Pat. No. 618,061.

It has been strongly desired to increase the sensitivity of silver halide emulsions as high as possible, and for that purpose, attempts to increase the sensitivity of silver halide emulsions by adding further a new sensitizing technique to a well-known sensitizing technique have been made.

For example, U.S. Pat. Nos. 3,625,697, 3,622,329, and 3,574,709 disclose the technique of using a wellknown sensitization technique together with certain organic thioether compounds.

However, these attempts are not always satisfactory and suffer from the defects, for example, that fog is excessively increased, the extent of the progress of chemical ripening is changed by adding said new sensitizing technique (which makes it difficult to control the extent of chemical ripening), and when silver halide emulsions are stored in a refrigerator, etc., in a solidified state, by cooling during the period from chemical ripening to coating, the properties thereof are degraded. Also, the sensitivity itself is not always satisfactory.

SUMMARY OF THE INVENTION

An object of this invention is, therefore, to provide silver halide photographic materials using highly sensitized silver halide emulsions which are not accompanied by the aforesaid defects.

Another object of this invention is to provide a process of sensitizing silver halide emulsions which are not accompanied by a significant increase in fog and without causing change in the preceding extent of chemical ripening.

A still further object of this invention is to provide high-speed silver halide emulsions having good preservability in a refrigerator.

Other objects of this invention will become apparent from the description below.

These objects of this invention are attained in silver halide photographic materials according to this invention, comprising silver halide photographic emulsions chemical-ripened in the presence of the compound represented by the formula (I) or (II),

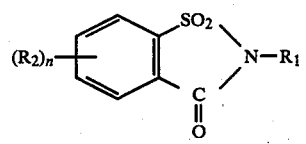

(I)

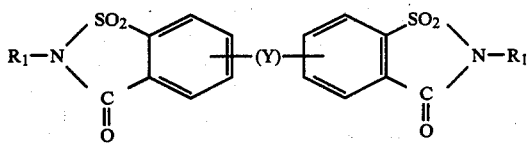

(II)

wherein $R_1$ represents hydrogen, an alkali metal ion, or an ammonium ion; $R_2$ represents an alkyl group, an alkoxy group, an acyl group, an aryloxy group, an amino group, a substituted amino group, a halogen atom, an acyloxy group, an acylamino group, a carbamoyl group, an aryl group, an allyl group, a nitro group, a sulfo group or a carboxy group; Y represents a divalent linking group; and n is 0, 1 or 2.

DETAILED DESCRIPTION OF THE INVENTION

In the formulae (I) and (II), $R_1$ represents hydrogen, an alkali metal ion (e.g., a sodium ion, a potassium ion, etc.), or an ammonium ion; $R_2$ represents an alkyl group having 1 to 6 carbon atoms (e.g., methyl group), an alkoxy group having 1 to 6 carbon atoms (e.g., methoxy group), an acyl group having 1 to 6 carbon atoms (e.g., acetyl group), an aryloxy group preferably phenoxy group, an amino group, a substituted amino group having total carbon atoms of 1 to 10 (e.g., diethylamino group), a halogen atom (e.g., chlorine or bromine), an acyloxy group having 1 to 6 carbon atoms (e.g., methoxycarbonyl group), an acylamino group having 1 to 6 carbon atoms (e.g., acetylamino group), a carbamoyl group having 2 to 10 carbon atoms, an aryl group preferably phenyl group, an allyl group, a nitro group, a sulfo group or a carboxy group; Y represents a divalent linking group (e.g., $-SO_2-$, $-CO-$, $-NH-SO_2NH-$); and n is 0, 1 or 2.

In this invention, the compounds according to formula (I) or (II) can be used, but the compounds of formula (I) are more preferred. Combinations of compounds according to formula (I) and/or (II) can also be used according to the invention, and reference to the compound herein is to be understood to refer to such combinations also.

In preferred compounds of formula (I), $R_1$ represents an alkali metal ion such as sodium ion, potassium ion, etc., or ammonium ion and $R_2$ represents an alkyl group, an alkoxy group, an acyloxy group, an acyl group, an amino group, a substituted amino group, a halogen atom, an acylamino group, a carbamoyl group, or a carboxy group; and most preferably n is 0.

Useful examples of the compounds according to formula (I) or (II) are shown below, although the compounds useful in this invention are not limited thereto.

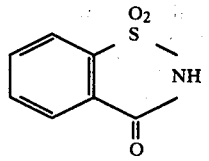
Compound I-1

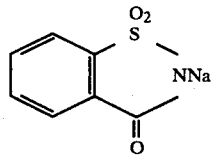
Compound I-2

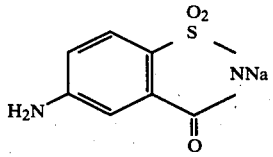
Compound I-3

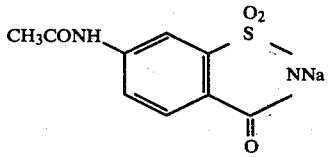
Compound I-4

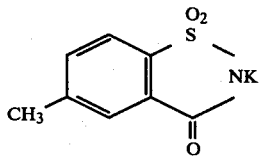
Compound I-5

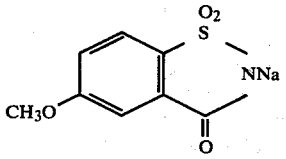
Compound I-6

-continued

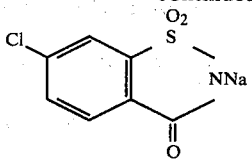
Compound I-7

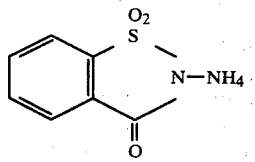
Compound I-8

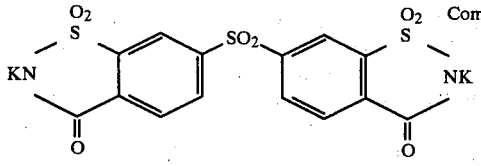
Compound II-1

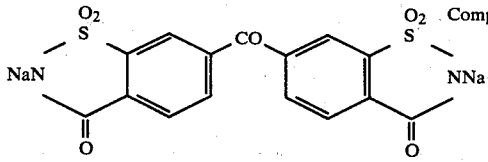
Compound II-2

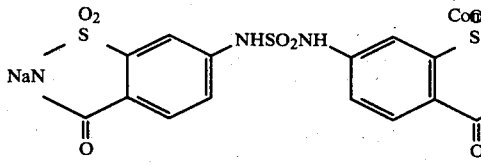
Compound II-3

The compounds according to formula (I) or (II) can be prepared by reference to the descriptions thereof, for example, in *Advances in Heterocyclic Chemistry,* Vol. 15, p. 233 (1973), *Journal of Organic Chemistry,* Vol. 36, p. 1843 (1971), *Journal of American Pharm. Association Society,* Vol. 49, p. 280 (1960), and U.S. Pat. No. 2,957,883.

A compound of this invention as shown by formula (I) or (II) is added to a silver halide emulsion before completion of chemical ripening, preferably in at least one step selected from: (1) a precipitation step of silver halide grains, (2) a physical ripening step (i.e., a pre-ripening step) subsequent to the precipitation step, and (3) a chemical ripening step (i.e., a post-ripening step).

The amount of the compound of formula (I) or (II) added to silver halide emulsion is preferably from 0.05 to 200 g, and more preferably from 0.1 to 100 g, per mol of silver halide before a pre-ripening step and in a pre-ripening step, and preferably from 0.001 to 10 g, and more preferably from 0.005 to 3 g, per mol of silver halide in a post-ripening step.

It is preferred that the amount of the compound of formula (I) or (II) existing finally in a silver halide emulsion of a silver halide photographic material be from 0.001 to 10 g, and more preferably from 0.005 to 3 g, per mol of silver halide.

Compounds (I-1) and (I-2) are usually called saccharin and it is disclosed in, for example, U.S. Pat. No. 1,763,989 and in *Journal of the Society of Photographic Science and Technology of Japan,* No. 11, pp. 48–76 (1948). The former suggests an anti-fogging action but the latter reports that no anti-fogging action was observed, which coincides with the results observed in the examples reported in this specification.

In U.S. Pat. Nos. 3,152,904, 3,080,254 and 3,730,727 silver saccharin is used as an oxidizing agent for dry photography, but this use is quite different from the instant invention in the objects, effects, and results obtained.

The above-described prior arts disclose only examples of adding saccharin after completion of the chemical ripening step. On the other hand, the present invention provides novel effects (sensitization, and improvement in cold stability with the passage of time) by using a compound of formula (I) or (II) in combination with a chemical sensitizer in a chemical ripening step and hence differ from the aforesaid techniques in object, construction and effect.

When a compound shown by formula (I) or (II) is present during chemical ripening, the sensitivity of the silver halide emulsion is increased without being accompanied by a significant increase in fog, and chemical ripening proceeds without substantial change, which facilitates control thereof, and furthermore, the stability properties of the silver halide emulsion under refrigeration is greatly improved, all of which are beyond ordinary expectation. Also, the effect of this invention is further promoted if the compound of formula (I) or (II) is present in a silver halide emulsion during ripening thereof and the silver halide emulsion is also chemically sensitized by a conventionally known chemical sensitizer.

Chemical sensitizers conventionally known that can be used together with the compound of this invention according to formula (I) or (II) include sulfur sensitizers, noble metal sensitizers, reducing sensitizers, etc., but, in particular, the use of compounds of formula (I) or (II) with noble metal sensitizers is particularly preferred.

With respect to the noble metal sensitizers, gold complex salts (e.g., those described in U.S. Pat. No. 2,399,083) are preferably used.

Examples of the particularly preferred gold complex salts are potassium chloroaurate, potassium aurithiocyanate, auric trichloride, and 2-aurosulfobenzothiazole methochloride.

Combinations of two or more kinds of the chemical sensitizers, such as noble metal sensitizers, sulfur sensitizers, etc., can be used together with the compound according to formula (I) or (II).

It is a necessary condition in this invention that the compound of the formula (I) or (II) of this invention must exist together with the conventional known chemical sensitizers during the chemical ripening step (i.e., post-ripening step). If this condition is satisfied, there is no particular restriction with respect to an addition time of the chemical sensitizers.

The conventional chemical sensitizers can be added to a silver halide emulsion during the formation of silver halide grains and/or during chemical ripening.

It is preferred that the amount of a sulfur sensitizer used is from about $5\times10^{-6}$ to $10^{-2}$ mol per mol of silver halide, the amount of a noble metal sensitizer used is from about $10^{-9}$ to $10^{-3}$ mol, and particularly from $10^{-8}$ to $10^{-4}$ mol, per mol of silver halide.

The silver halide for the silver halide emulsions used in this invention can be silver bromide, silver iodobromide, silver iodochlorobromide, silver chlorobromide, and silver chloride, and combinations thereof.

There is no particular limitation on the mean grain size of the silver halide grains (when the silver halide grains are spherical or almost spherical grains, the grain size is the diameter of the grain, and when the silver halide grains are cubic grains, the grain size is the length of the edge, which is shown by the average based on the projected area) but it is preferred that the mean grain size be from 0.1 to 3 microns. The grain size distribution may be narrow or wide.

The silver halide grains may comprise regular crystal forms, such as cubic or octahedron, or may comprise irregular crystal forms, such as spherical and plate crystals, or further may be mixed crystal systems of such crystal forms. Also, the silver halide grains may comprise a mixture of these various crystal grains.

The silver halide grains used in this invention may have different phases between the inside and the surface layer thereof, or may be one composed of uniform phase. Also, the silver halide grains may be those forming latent images mainly on the surface thereof, or those forming latent images mainly inside the grains.

The silver halide emulsions of this invention can be prepared using the processes described in, for example, P. Glafkides, *Chimie et Physique Photographique* (Paul Montel, 1967), G. F. Duffin, *Photographic Emulsion Chemistry* (The Focal Press, 1966), and V. L. Zelikman, et al., *Making and Coating Photographic Emulsion* (The Focal Press, 1964). The emulsions may be prepared by an acid process, a neutralization process, an ammonia process, etc., and systems for reacting a soluble silver salt and a soluble halide that can be used include one-side mixing process, a simultaneous mixing process, or a combination thereof.

A process for forming silver halide grains in the presence of excessive silver ions (the so-called "back mixing" process) can be used. In one mode of the simultaneous mixing process, a process of maintaining the pAg of the liquid phase forming the silver halide at a constant value, that is, the so-called "controlled double jet" process, can be used.

According to this process silver halide emulsions having regular crystal form and almost uniform grain size are obtained. Two or more kinds of silver halide emulsions prepared separately can be used as a mixture thereof, if desired.

In the step of forming silver halide grains or the physical ripening thereof, a cadmium salt, a zinc salt, a lead salt, a thallium salt, an iridium salt or the complex salt thereof, a rhodium salt or the complex salt thereof, an iron salt or the complex salt thereof, etc., may be present in the silver halide emulsion. Also, as a silver halide solvent, ammonia, potassium thiocyanate, or a thioether compound can be used.

The conditions for the formation and precipitation of silver halide grains in the physical ripening thereof that are preferred are a temperature of from 30° to 90° C., and particularly from 40° to 80° C., a pH of from 1 to 11, and particularly from 2 to 9, and a pAg of from 5 to 11, and particularly from 7.8 to 10.5.

After the physical ripening step (pre-ripening step), the silver halide emulsion is preferably washed with water to remove unnecessary water-soluble salt. The water washing process are described, for example, in *Research Disclosure*, No. 17644, p. 23 (December, 1978). When the compound of the formula (I) or (II) of this invention is added to the silver halide emulsion before or during the pre-ripening step in the amount described above (i.e., 0.1 to 100 g per mol of silver halide), a necessary amount of the compound of the formula (I) or (II) can remain in the silver halide emulsion after the water washing of the silver halide emulsion. Thus, there is no problem in the chemical ripening step according to the invention since the water-washed silver halide emulsion still contains the necessary amount of the compound of the formula (I) or (II).

After water washing, the silver halide emulsion is chemical-ripened. The conditions for chemical ripening, it is preferred that the temperature be from 30° to 80° C., and particularly from 40° to 70° C., that the pH be from 3.0 to 8.5, and particularly from 5.0 to 7.5, that the pAg be from 7.0 to 9.5, and particularly from 8.0 to 9.3, and that the time thereof be from 10 to 200 minutes, and particularly from 30 to 120 minutes.

It is advantageous to use gelatin as a binder or a protective colloid for the silver halide emulsion, but other hydrophilic colloids than gelatin can also be used in this invention. For example, gelatin derivatives, graft polymers of gelatin and other polymers; proteins such as albumin, casein, etc.; cellulose derivatives such as hydroxyethyl cellulose, carboxymethyl cellulose, cellulose sulfuric acid esters, etc.; sugar derivatives such as sodium alginate, starch derivatives, etc.; and various synthetic hydrophilic polymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, can also be used.

The silver halide emulsions used in this invention may contain various compounds for the purposes of preventing the occurrence of fog during the preparation, preservation, or photographic processing of the photographic materials, as well as stabilizing the photographic properties of the photographic materials. These various antifoggants and stabilizers include azoles, such as benzothiazolium salts, nitroindazoles, nitrobenzimidazoles, chlorobenzimidazoles, bromobenzimidazoles, mercaptothiazoles, mercaptobenzthiazoles, mercaptobenzimidazoles, mercaptothiazoles, aminotriazoles, benztriazoles, nitrobenztriazoles, mercaptotetrazoles (in particular, 1-phenyl-5-mercaptotetrazole), etc.; mercaptopyrimidines; mercaptotriazines; thioketo compounds such as oxazolinethion; azaindenes, such as triazaindenes, tetraazaindenes (in particular, 4-hydroxy-substituted (1,3,3a,7)tetraazaindenes), and pentaazaindenes; and benzenethiosulfonic acid, benzenesulfinic acid, benzenesulfonic acid amide, etc. For example, those described in U.S. Pat. Nos. 3,954,474 and 3,982,947 and Japanese Patent Publication No. 28660/77 can be used.

In the silver halide emulsions used in this invention, other photographic additives normally used in the art, such as gelatin hardening agents, surface active agents, spectral sensitizing dyes, polymer latexes, dyes, color couplers, fading preventing agents, etc., can also be used.

These additives and the production of silver halide emulsions therewith are described, for example, in *Research Disclosure*, Vol. 176, pp. 22–31 (December, 1978).

The silver halide photographic material of this invention can have on the support one or more other layers, such as a surface protective layer, interlayers, a filter layer, a subbing layer, a backing layer, an image-receiving layer, etc., in addition to the silver halide emulsion layer or layers.

Examples of supports that can be used in this invention include cellulose acetate films, polyethylene terephthalate films, polyolefin-coated papers, and so forth.

There are no particular restrictions with respect to the compositions of these other layers (for example, with respect to binders, gelatin hardening agents, surface active agents, antistatic agents, ultraviolet absorbents, mordants, polymer latexes, lubricants, plasticizers, matting agents, adhesion improving agents, dyes, etc.), and the coating and drying processes for the silver halide emulsion layers and other layers, and the exposure and developing processes for the silver halide photographic materials that can be used are conventional, as described, for example, in *Research Disclosure*, Vol. 176, pp. 22–31 (December, 1978).

The following examples are intended to illustrate the invention, but not to limit it in any way.

EXAMPLE 1

While stirring an aqueous gelatin solution containing potassium iodide and potassium bromide at 70° C., an aqueous solution of potassium bromide and an aqueous solution of silver nitrate were simultaneously added to the gelatin solution to prepare a silver iodobromide emulsion (I: 0.5 mol%) having a mean grain size of about 0.8 micron. The compound of this invention was added to the aqueous gelatin solution as shown in Table 1.

The silver halide emulsion was solidified by cooling and washed with water according to a flocuration method to remove unnecessary salts (If it is assumed that the compound of this invention is not absorbed to the surface of the gelatine or the silver halide of the emulsion the amount of the compound of this invention remaining after water washing is calculated to be 50 mg/mol-$AgNO_3$), adjusted to desired pH value and pAg value (pH 6.5 and pAg 8.9), heated to 60° C., chemically ripened with the addition of sodium thiosulfate and potassium chloroaurate, and sampled as shown in Table 1.

After adding to each of the silver halide emulsions the following sensitizing dye, stabilizer, color coupler, gelatin hardening agent, and coating aid, the silver halide emulsion was coated on a cellulose acetate film and dried to provide Sample 2.

For the sake of comparison, the same procedure as above was followed without adding the compound of this invention to the aqueous gelatin solution, to provide Sample 1-1.

For further comparison, the same procedure as in the Sample 1-1 above was followed except that 50 mg, 100 mg, or 500 mg/mol-$AgNO_3$ of the compound of this invention was added to the the silver halide emulsion after adding the coating aid to the emulsion to provide Samples 1-2, 1-3 and 1-4, respectively.

Sensitizing dye: 5,5'-dichloro-3,3'-di(γ-sulfopropyl)-9-ethyloxacarbocyanine sodium salt.

Stabilizer: 4-hydroxy-6-methyl-1,3,3a,7-tetraazaindene.

Coupler: 1-(2,4,6-trichlorophenyl)-3-[3-(2,4-di-t-amylphenoxy)acetamido]benzamido-5-pyrazolone.

Gelatin hardening agent: 2,4-dichloro-6-hydroxy-s-triazine.

Coating aid: sodium dodecylbenzenesulfonate.

Each of these samples was exposed for 1/100 second through an optical wedge, and after color-processing the sample as shown below, the photographic properties were measured, the results being shown in Table 1.

In addition, the photographic sensitivity was shown by the relative value of the reciprocal of an exposure amount required to obtain the optical density of fog+0.20, and the sensitivity of Sample 1 chemically ripened for 60 minutes was taken as 100 in Table 1.

TABLE 1

| | | Chemical Ripening Time | | | | | |
|---|---|---|---|---|---|---|---|
| | | 40 Minutes | | 60 Minutes | | 80 Minutes | |
| Sample | Compound | Fog | Relative Sensitivity | Fog | Relative Sensitivity | Fog | Relative Sensitivity |
| 1-1 | — | 0.10 | 80 | 0.13 | 100 | 0.18 | 115 |
| 2 (invention) | Compound I-2 (6.8 g/mol-$AgNO_3$) | 0.10 | 102 [81 | 0.13 | 126 100 | 0.18 | 143 113]* |
| 1-2 | Compound I-2 (50 mg/mol-$AgNO_3$) | 0.10 | 78 | 0.13 | 98 | 0.19 | 113 |
| 1-3 | Compound I-2 (100 mg/mol-$AgNO_3$) | 0.11 | 81 | 0.13 | 97 | 0.19 | 114 |
| 1-4 | Compound I-2 (500 mg/mol-$AgNO_3$) | 0.10 | 80 | 0.13 | 96 | 0.18 | 110 |

*The relative sensitivities within brackets [ ] for Sample 2 are values based on that of Sample 2 after chemical ripening of 60 minutes being taken as 100.

As is clear from the results in Table 1, when the silver halide emulsion was chemically ripened in the presence of the compound of this invention, the sensitivity was increased without an accompanying in the formation of fog. Also, the extent of the progress of chemical ripening did not change, and hence the chemical ripening could be controlled easily. On the other hand, Samples 1-2 to 1-4 to which the compound of this invention was added after completion of ripening steps, showed almost no sensitization effects.

| Color Processing Conditions: | |
|---|---|
| 1. Color development | 3 min 15 sec (38° C.) |
| 2. Bleach | 6 min 30 sec |
| 3. Wash | 3 min 15 sec |
| 4. Fix | 6 min 30 sec |
| 5. Wash | 3 min 15 sec |
| 6. Stabilization | 3 min 15 sec |

The compositions of the processing solutions used in the above processing were as follows:

| | |
|---|---|
| Color Developer: | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N-Ethyl-N-β-hydroxyethylamino)-2-methylaniline sulfate | 4.5 g |
| Water to make | 1 l |
| Bleach Solution: | |
| Ammonium bromide | 160.0 g |
| Aqueous ammonia (28%) | 25.0 ml |
| Ethylenediaminetetraacetic acid sodium iron salt | 130 g |
| Glacial acetic acid | 14 ml |
| Water to make | 1 l |
| Fix Solution: | |
| Sodium tetrapolyphosphate | 2.0 g |
| Sodium sulfite | 4.0 g |
| Ammonium thiosulfate (70%) | 175.0 ml |
| Sodium hydrogensulfite | 4.6 g |
| Water to make | 1 l |
| Stabilizing Solution: | |
| Formalin | 8.0 ml |
| Water to make | 1 l |

COMPARATIVE EXAMPLE 1

A silver iodobromide emulsion was prepared by the same way as in Example 1. In this case, however, the silver halide emulsion was heated to 60° C. for 60 minutes without adding chemical sensitizers such as sodium thiosulfate and potassium chloroaurate. After adding thereto additives as in Example 1, the same processing as in Example 1 was practiced. The results are shown below.

| Sample | Compound | Fog | Relative Sensitivity |
|---|---|---|---|
| 3 | — | 0.05 | 100* |
| 4 | I-2 (4.6 g/mol-$AgNO_3$) | 0.05 | 100 |

*The relative sensitivity of Sample 3 was taken as 100.

As is clear from the above table, when the compound of this invention was used alone, neither sensitizing action nor antifogging action was obtained.

EXAMPLE 2

A silver iodobromide was prepared as in Sample 1 in Example 1. After washing with water and adjusting the pH and pAg values of the silver halide emulsion, the emulsion was divided into 5 portions. Each of the silver halide emulsions was heated to 60° C. and after adding to the emulsion sodium thiosulfate, potassium chloroaurate and the compound of this invention as shown in Table 2, the silver halide emulsion was chemically ripened for 60 minutes and then coated and dried as in Example 1 to provide Samples 11-15 (Sample 11 did not contain the compound of this invention). These samples were developed as in Example 1. The results of measuring the photographic properties are shown in Table 2.

TABLE 2

| Sample | Compound | Fog | Relative Sensitivity |
|---|---|---|---|
| 11 | — | 0.13 | 100 |
| 12 | Compound I-2 (0.1 g/mol-$AgNO_3$) | 0.13 | 128 |
| 13 | Compound I-4 (0.1 g/mol-$AgNO_3$) | 0.13 | 124 |
| 14 | Compound I-6 (0.1 g/mol-$AgNO_3$) | 0.13 | 122 |
| 15 | Compound II-1 (0.1 g/mol-$AgNO_3$) | 0.13 | 120 |

As is clear from the results in Table 2 above, when the compound of this invention was added during chemical ripening of the silver halide emulsion, the sensitivity was increased without an accompanying in the formation of fog.

EXAMPLE 3

For testing the stabilization of the silver halide emulsions during preservation in a refrigerator, silver halide emulsions 1 and 2 (ripened for 60 minutes but did not contain the additives for adding after chemical ripening) used in Samples 1 and 2 in Example 1 were prepared and after preserving them in a refrigerator at about 5° C. for about 2 months and adding the additives for adding after chemical ripening as in Example 1 to the emulsions, each of the silver halide emulsions was coated and dried to provide Samples 21 and 22.

Samples 1 and 2 (prepared by coating silver halide emulsions directly after the preparation thereof) in Example 1 and Samples 21 and 22 were processed as in Example 1, the results obtained being shown in Table 3.

TABLE 3

| Sample | Relative Sensitivity |
|---|---|
| 1 | 100 |
| 2 (invention) | 126 |
| 21 | 93 |
| 22 (invention) | 125 |

Thus, from Table 3 it appears that when ordinary silver halide emulsions thus prepared were preserved for about 2 months in a refrigerator, the sensitivity thereof was reduced but in the silver halide emulsions containing the compound of this invention according to this invention, the degradation of photographic properties (reduction in sensitivity) thereof during the preservation thereof in refrigerator could be prevented.

EXAMPLE 4

To an aqueous gelatin solution containing a small amount of sodium chloride were added simultaneously an aqueous solution of sodium chloride and potassium bromide and an aqueous solution of silver nitrate with stirring at 50° C. to provide a silver chlorobromide emulsion having a mean grain size of about 0.3 micron. In this case, the compound of this invention was added to the aqueous gelatin solution as shown in Table 4.

The silver halide emulsion was washed with water as in Example 1 and then chemically ripened for 40 minutes at 55° C. with sodium thiosulfate and potassium chloroaurate.

After adding thereto 4-hydroxy-6-methyl-1,3,3a,7-tetraazaindene, 2,4-dichloro-6-hydroxy-s-triazine, etc., as in Example 1, the silver halide emulsion was coated and dried. Thus, Samples 31–34 were prepared (Sample 31 did not contain the compound used according to this invention).

After exposure, each of the samples was developed in a Kodak D-16 developer for 3 minutes at 20° C. and then stopped, fixed, washed and dried. The results are shown in Table 4.

TABLE 4

| Sample | Compound | Fog | Relative Sensitivity |
|---|---|---|---|
| 31 | — | 0.05 | 100 |
| 32 | Compound I-2 (4 g/mol-$AgNO_3$) | 0.05 | 128 |

TABLE 4-continued

| Sample | Compound | Fog | Relative Sensitivity |
|---|---|---|---|
| 33 | Compound I-7 (4.6 g/mol-$AgNO_3$) | 0.05 | 122 |
| 34 | Compound II-3 (5 g/mol-$AgNO_3$) | 0.05 | 123 |

As is clear from the results in Table 4 above, even in a case of a silver chlorobromide emulsion, the sensitivity can be increased without an accompanying in the formation of fog by adding the compound of this invention during the chemical ripening.

EXAMPLE 5

A silver iodobromide emulsion was prepared as in Sample 1 in Example 1. In this case, however, the silver halide was washed with water, adjusted to the desired pH and pAg values, and divided into 8 portions. Each of the silver halide emulsion was heated to 60° C. and after adding thereto sodium thiosulfate, potassium chloroaurate, stannous chloride, and the compound of this invention as shown in Table 5, ripened for 60 minutes. Thereafter, Samples 41–48 were prepared as in Example 1 using the silver halide emulsions, and each of the samples was processed as in Example 1. The results are shown in Table 5.

TABLE 5

| Sample | Compound Added | Relative Sensitivity |
|---|---|---|
| 41 | Sodium thiosulfate | 100 |
| 42 | Sodium thiosulfate + Compound I-2 | 112 |
| 43 | Potassium chloroaurate | 100 |
| 44 | Potassium chloroaurate + Compound I-2 | 120 |
| 45 | Sodium thiosulfate + potassium chloroaurate | 100 |
| 46 | Sodium thiosulfate + potassium chloroaurate + Compound I-2 | 128 |
| 47 | Stannous chloride | 100 |
| 48 | Stannous chloride + Compound I-2 | 110 |

In the table, the relative sensitivity is shown based on those of Samples 41, 43, 45 and 47 as 100, and the amount of Compound I-2 was 0.1 g/mol-$AgNO_3$ in each case.

As is clear from Table 5, the compound used according to this invention showed a sensitization effect in the combinations with all chemical sensitizers, but the combination with the nobel metal sensitizer was most effective.

While the invention has been described in detail and with reference to specific embodiments thereof, it will be apparent to one skilled in the art that various changes and modifications can be made therein without departing from the spirit and scope thereof.

What is claimed is:

1. In a process for producing a silver halide photographic material comprising the steps of (1) a precipitating step of silver halide grains to obtain a silver halide emulsion;

(2) a physical ripening step of the silver halide grains of the silver halide emulsion;

(3) a chemical ripening step of the physical-ripened silver halide grains of the silver halide emulsion;

(4) an adding step of additives to the chemical-ripened silver halide emulsion; and (5) an coating step of the silver halide emulsion on a support, characterized in that step (3) is conducted in the presence of a noble metal sensitizer and for a compound represented by the formula (I) or (II)

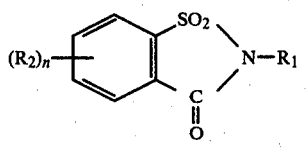

(I)

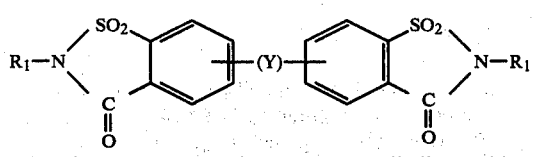

(II)

wherein $R_1$ represents hydrogen, an alkali metal ion, or an ammonium ion; $R_2$ represents an alkyl group, an alkoxy group, an aryloxy group, an acyl group, an amino group, a substituted amino group, a halogen atom, an acyloxy group, an acylamino group, a carbamoyl group, a nitro group, an aryl group, an allyl group, a sulfo group or a carboxy group; Y represents a divalent linking group; and n is 0, 1, or 2.

2. A process for producing a silver halide photographic material as in claim 1, wherein the compound of formula (I) or (II) is added to the silver halide emulsion before a pre-ripening or in a pre-ripening step in an amount of from about 0.05 to 200 g per mol of silver halide.

3. A process for producing a silver halide photographic material as in claim 1, wherein the compound of formula (I) or (II) is added to the silver halide emulsion in a chemical-ripening step in an amount of from about 0.001 to 10 g per mol of silver halide.

4. A silver halide photographic material as in claim 1, wherein said chemical ripening step is conducted in the further presence of a sulfur sensitizer.

5. A process for producing a silver halide photographic material as in claim 1, wherein in formula (I) $R_1$ represents an alkali metal ion, or an ammonium ion and $R_2$ represents an alkyl group, an alkoxy group, an acyloxy group, an acyl group, an amino group, a substituted amino group, a halogen atom, an acylamino group, a carbamoyl group, or a carboxyl group.

6. A process for producing a silver halide photographic material as in claim 5, $R_2$ represents an alkyl group having 1 to 6 carbon atoms, an alkoxy group having 1 to 6 carbon atoms, an acyloxy group having 1 to 6 carbon atoms, an acyl group having 1 to 6 carbon atoms, an amino group, a substituted amino group having total carbon atoms of 1 to 10, a halogen atom, an acylamino group having 1 to 6 carbon atoms, a carbamoyl group having 2 to 10 carbon atoms, or a carboxyl group.

7. A process for producing a silver halide photographic material as in claim 1, wherein in formula (I) n represents 0.

8. A process for producing a silver halide photographic material as in claim 1, wherein the compound of formula (I) or (II) is added to the silver halide emulsion before completion of chemical-ripening.

9. A process for producing a silver halide photographic material as in claim 1, wherein the compound of formula (I) or (II) is added to the silver halide emulsion in a precipitation step of silver halide grains.

10. A process for producing a silver halide photographic material as in claim 1, wherein the compound of formula (I) or (II) is added to the silver halide emulsion in a physical ripening step.

11. A process for producing a silver halide photographic material as in claim 1, wherein the compound of formula (I) or (II) is added to the silver halide emulsion in a chemical-ripening step.

12. A process for producing a silver halide photographic material as in claim 2, wherein the compound of formula (I) or (II) is added to the silver halide emulsion in the pre-ripening step in an amount of from 0.05 to 200 g per mol of silver halide.

13. A process for producing a silver halide photographic material as in claim 12, wherein the compound of formula (I) or (II) is added to the silver halide emulsion in the pre-ripening step in an amount of from 0.1 to 100 g per mol of silver halide.

14. A process for producing a silver halide photographic material as in claim 3, wherein the compound of formula (I) or (II) is added to the silver halide emulsion in the chemical-ripening step in an amount of from 0.005 to 3 g per mol of silver halide.

15. A process for producing a silver halide photographic material as in claim 1, 2, 3, or 4, wherein the amount of compound represented by the formula (I) or (II) in the silver halide emulsion is from 0.001 to 10 g per mol of silver halide.

16. A process for producing a silver halide photographic material as in claim 1, 2, 3, or 4, wherein the amount of compound represented by the formula (I) or (II) in the silver halide emulsion is from 0.005 to 3 g per mol of silver halide.

17. A process for producing a silver halide photographic material as in claim 2, wherein the addition of the compound of formula (I) or (II) is conducted at a temperature of from 30° to 90° C., a pH of from 1 to 11, and a pAg of from 5 to 11.

18. A process for producing a silver halide photographic material as in claim 17, wherein the addition of the compound of formula (I) or (II) is conducted at a temperature of from 40° to 80° C., a pH of from 2 to 9, and a pAg of from 7.8 to 10.5.

19. A process for producing a silver halide photographic material as in claim 3, wherein the compound of formula (I) or (II) is added to the silver halide emulsion at a temperature of from 30° to 80° C., a pH of from 3.0 to 8.5, and a pAg of from 7.0 to 9.5.

20. A process for producing a silver halide photographic material as in claim 19, wherein the compound of formula (I) or (II) is added to the silver halide emulsion at a temperature of from 40° to 70° C., a pH of from 5.0 to 7.5, and a pAg of from 8.0 to 9.3.

21. A process for producing a silver halide photographic material as in claim 1, wherein said noble metal sensitizer is a gold complex salt.

22. A process for producing a silver halide photographic material as in claim 21, wherein said gold complex salt is selected from the group consisting of potassium chloroaurate, potassium aurithiocyanate, auric trichloride and 2-aurosulfobenzothiazole methochloride.

23. A process for producing a silver halide photographic material as in claim 1, 21 or 22, wherein said noble metal sensitizer is used in an amount of from $10^{-9}$ mol to $10^{-3}$ mol per mole of silver halide.

24. A process for producing a silver halide photographic material as in claim 4, wherein said sulfur sensitizer is used in an amount of from $5\times10^{-6}$ mol to $10^{-2}$ mol per mol of silver halide.

25. A silver halide photographic material produced by the process of:

precipitating silver halide grains to obtain a silver halide emulsion;

ripening the silver halide grains of silver halide emulsion; chemically ripening the physically ripened silver halide grains of the silver halide emulsion;

adding additives to the chemically-ripened silver halide emulsion; and coating the silver halide emulsion on a support, characterized in that said chemical ripening step is conducted in the presence of a noble metal sensitizer and a compound represented by the formula (I) or (II)

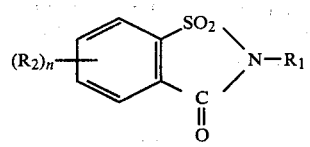

(I)

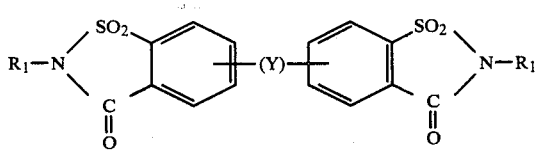

(II)

wherein $R_1$ represents hydrogen, an alkali metal ion, or an ammounium ion; $R_2$ represents an alkyl group, an alkoxy group, an aryloxy group, an acyl group, an amino group, a substituted amino group, a halogen atom, an acyloxy group, acylamino group, a carbamoyl group, a nitro group, an aryl group, an allyl group, a sulfo group or a carboxy group; Y represents a divalent linking group and n is 0, 1, or 2.

* * * * *